US008141649B2

(12) United States Patent
Kotliar

(10) Patent No.: US 8,141,649 B2
(45) **Date of Patent: *Mar. 27, 2012**

(54) HYPOXIC FIRE SUPPRESSION SYSTEM FOR AEROSPACE APPLICATIONS

(75) Inventor: Igor K. Kotliar, New York, NY (US)

(73) Assignee: FirePass Corporation, New York, NY (US)

( * ) Notice: Subject to any disclaimer, the term of this patent is extended or adjusted under 35 U.S.C. 154(b) by 1893 days.

This patent is subject to a terminal disclaimer.

(21) Appl. No.: 11/183,948

(22) Filed: Jul. 19, 2005

(65) Prior Publication Data

US 2005/0263298 A1 Dec. 1, 2005

Related U.S. Application Data

(63) Continuation-in-part of application No. 10/726,737, filed on Dec. 3, 2003, now Pat. No. 7,900,709, and a continuation-in-part of application No. 09/551,026, filed on Apr. 17, 2000, now Pat. No. 6,314,754, and a continuation-in-part of application No. 09/566,506, filed on May 8, 2000, now Pat. No. 6,334,315, and a continuation-in-part of application No. 09/854,108, filed on May 11, 2001, now Pat. No. 6,401,487, and a continuation-in-part of application No. 09/750,801, filed on Dec. 28, 2000, now Pat. No. 6,418,752, and a continuation-in-part of application No. 09/975,215, filed on Oct. 10, 2001, now Pat. No. 6,502,421, and a continuation-in-part of application No. 10/078,988, filed on Feb. 19, 2002, now Pat. No. 6,557,374, and a continuation-in-part of application No. 10/024,079, filed on Dec. 17, 2001, now Pat. No. 6,560,991.

(51) Int. Cl.
*A62C 2/00* (2006.01)

(52) U.S. Cl. ..... 169/45; 169/14; 169/37; 169/44; 169/46; 169/61; 169/62; 244/129.2; 96/134; 95/96; 239/8; 239/418

(58) Field of Classification Search ..... 169/37, 169/45, 46, 56, 61, 62, 14, 44; 62/78, 640; 244/129.2, 135 R; 96/134; 95/96, 130; 239/8, 239/418

See application file for complete search history.

(56) References Cited

U.S. PATENT DOCUMENTS 3,893,514 A 7/1975 Carhart et al.

(Continued)

FOREIGN PATENT DOCUMENTS

WO WO 96/37176 11/1996

OTHER PUBLICATIONS

William M. Cavage, Federal Aviation Administration, Atlantic City, NJ, and Timothy Bowman, Boeing Phantom Works, St. Louis, MO, *Modeling In-flight Inert Gas Distribution in a 747 Center Wing Fuel Tank*, AIAAFDC32143b.pdf, 598 Kb, 13 pages, FAA White Papers.

(Continued)

*Primary Examiner* — Steven J Ganey

(74) *Attorney, Agent, or Firm* — Orrick, Herrington & Sutcliffe LLP

(57) ABSTRACT

A fire suppression system and a method for providing fire suppression onboard of an aircraft by rapidly establishing a breathable hypoxic atmosphere onboard of an aircraft, which can be generated by an air separation device utilizing a positive pressure of the bleed air and a negative pressure of the outside atmosphere; breathable hypoxic fire-extinguishing agent, containing 12%-18% of oxygen, can flood protected compartments of an aircraft in case of a fire and/or can be used as propellant for generating water mist or foam.

34 Claims, 1 Drawing Sheet

U.S. PATENT DOCUMENTS

| | | | | |
|---|---|---|---|---|
| 3,948,626 | A | 4/1976 | Bragg | |
| 4,378,920 | A | 4/1983 | Runnels | |
| 4,556,180 | A | 12/1985 | Manatt | |
| 4,681,602 | A | 7/1987 | Glenn | |
| 4,807,706 | A | 2/1989 | Lambertsen et al. | |
| 4,896,514 | A | 1/1990 | Sugiyama et al. | |
| 5,063,753 | A | 11/1991 | Woodruff | |
| 5,220,799 | A | 6/1993 | Lievens et al. | |
| 5,273,344 | A | 12/1993 | Volkwein et al. | |
| 5,308,382 | A | 5/1994 | Prasad | |
| 5,388,413 | A | 2/1995 | Major et al. | |
| 5,472,480 | A | 12/1995 | Barbe | |
| 5,649,995 | A | 7/1997 | Gast, Jr. | |
| 5,730,780 | A | 3/1998 | Booth, III | |
| 5,799,495 | A | 9/1998 | Gast, Jr. et al. | |
| 5,799,652 | A | 9/1998 | Kotliar | |
| 5,887,439 | A | 3/1999 | Kotliar | |
| 5,921,091 | A | 7/1999 | Foss et al. | |
| 6,012,533 | A | 1/2000 | Cramer | |
| 6,112,822 | A | 9/2000 | Robin et al. | |
| 6,314,754 | B1 | 11/2001 | Kotliar | |
| 6,334,315 | B1 | 1/2002 | Kotliar | |
| 6,418,752 | B2 | 7/2002 | Kotliar | |
| 6,547,188 | B2 | 4/2003 | Schmutz et al. | |
| 6,604,558 | B2 | 8/2003 | Sauer | |
| 6,634,598 | B2 | 10/2003 | Susko | |
| 6,729,359 | B2 | 5/2004 | Jones | |
| 6,739,359 | B2 | 5/2004 | Jones et al. | |
| 6,739,400 | B2 * | 5/2004 | Lessi et al. | 169/46 |
| 6,997,970 | B2 * | 2/2006 | Crome | 95/130 |
| 7,152,635 | B2 | 12/2006 | Moravec et al. | |
| 2005/0173017 | A1 | 8/2005 | Moravec et al. | |

OTHER PUBLICATIONS

William M. Cavage, Fire Safety Branch, Federal Aviation Administration, William J. Hughes Technical Center, Atlantic City International Airport, NJ, *Modeling of In-flight Fuel Tank Inerting for FAA OBIGGS Research*, 255 Kb, 11 pages, FAA White Papers.

William M. Cavage and Robert Morrison, Fire Safety Branch, Federal Aviation Administration, William J. Hughes Technical Center, Atlantic City Int'l Airport, NJ, *Development and Testing of the FAA Simplified Fuel Tank Inerting System*, Cavage-FAAOBIGGSDevelop &Test, 530 Kb, 11 pages, FAA White Papers.

Steven M. Summer, *Limiting Oxygen Concentration Required to Inert Jet Fuel Vapors Existing at Reduced Fuel Tank Pressures*, Aug. 2003, DOT/FAA/AR-TN02/79, 1.8 Mb, 32 pages, FAA White Papers.

William M. Cavage, Fire Safety Branch, Federal Aviation Administration, AAR-422, Building 204, William J. Hughes Technical Center, Atlantic City International Airport, NJ, *Ground-Based Inerting of Commercial Transport Aircraft Fuel Tanks*, RTO_AVT-GBI Paper 761 Kb, 20 pages, FAA White Papers.

William M. Cavage, Fire Safety Section, Federal Aviation Administration, Atlantic City International Airport, NJ, *Modeling Inert Gas Distribution . in Commercial Transport Aircraft Fuel Tanks*, AIAA Paper 2002-3032, Report 1300, 600 Kb, 8 pages, FAA White Papers.

Charles C. Graves and Donald W. Bahr, FAA-Propulsion Chemistry Division, *Basic Considerations in the Combustion of Hydrocarbon Fuels with Air*, NACA—1300, 24.04 Mb 26, 267 pages, FAA White Papers.

William M. Cavage, FAA, AAR-422, Fire Safety R&D, Copyright @ 2001 Society of Automotive Engineers, Inc., *Ground-Based Inerting of a Boeing 737 Center Wing Fuel Tank*, SAE-GBI, 281 Kb, 8 pages, FAA White Papers.

Michael Burns, William M. Cavage, Federal Aviation Administration, William J. Hughes Technical Center, Airport and Aircraft Safety, Research and Development Division, Atlantic City Int'l Airport, NJ 08405, *Ground and Flight Testing of a Boeing 737 Center Wing Fuel Tank Inerted With Nitrogen-Enriched Air* DOT/FAA/AR-01/63, 4.91 Mb, 34 pages, FAA White Papers.

Samuel V. Zinn, Jr., Nat'l Aviation Facilities Experimental Center, Atlantic City, NJ, Inerted Fuel Tank Oxygen Concentration Requirements, Aug. 1971, FAA-RD- 71-42 1.58 Mb, 23 pages, FAA White Papers.

Thomas L. Reynolds, et al., Boeing Commercial Airplanes Group, Seattle, Wash., *Onboard Inert Gas Generation System/Onboard Oxygen Gas Generation System*, May 2001, (OBIGGS/OBOGS) Study NASA/CR-2001-210903 7.75 Mb, 179 pages, FAA White Papers.

Michael Burns and William M. Cavage, Federal Aviation Administration, FAA William J. Hughes Technical Center, Airport and Aircraft Safety, Research and Development Division, Atlantic City Int'l. Airport, NJ, *Inerting of a Vented Aircraft Fuel Tank Test Article With Nitrogen Enriched Air*, Apr. 2001, 2.28 Mb., 29 pages, FAA White Papers.

Steven M. Summer, *Cold Ambient Temperature Effects on Heated Fuel Tank Vapor Concentrations*, Jul. 2000, DOT/FAA/AR-TN99-93, 395 Kb, 13 pages, FAA White Papers.

William M. Cavage, Airport and Aircraft Safety, Research and Development Division, FAA William J. Hughes Technical Center, Atlantic City International Airport, NJ, May 2000, *The Cost of Implementing Ground-Based Fuel Tank Inerting in the Commercial Fleet*, DOT/FAA/AR-00/19, 941 Kb, 60 pages, FAA White Papers.

*A Benefit Analysis for Nitrogen Inerting of Aircraft Fuel Tanks Against Ground Fire Explosion*, Dec. 1999, Final Report, DOT/FAA/AR-99/73 Office of Aviation Research, NTIS, Springfield, VA, 617 Kb, 117 pages.

Steveb M. Summers, *Mass Loading Effects on Fuel Vapor Concentrations in an Aircraft Fuel Tank Ullage*, Sep. 1999, DOT/FAA/AR-TN99/65, 934 Kb, 14 pages.

*A Review of the Flammability Hazard of Jet a Fuel Vapor in Civil Transport Aircraft Tanks*, Jun. 1998, Final Report, DOT/FAA/AR-98/26, 1.04 Mb, 62 pages, FAA White Papers.

Aircraft Accident Report, *In-Flight Breakup Over the Atlantic Ocean Trans World Airlines Flight 800*, National Transportation Safety Board, NTSB/AAR-00/03 7.63. Mb, 341 pages.

Daniel R. Bower, Ph.D., *Flight Test Group Chairman's Factual Report of Investigation*, Jul. 17, 1996, NTSB/SA-516, 96 Kb, 24 pages, FAA White Papers.

Ivor Thomas, *FAA R&D Efforts on Flammability*, Aug. 14, 2002, 2.3 Mb, 27 pages, FAA White Papers.

Alan Levin, *Lower cost, higher risk helped alter FAA stance*, (McLean, VA: Feb. 17, 2004. p. A.03), Copyright 2004 Gannett Company, Inc., USA Today.

Alan Levin, *FAA Suggests Airbus Modify Jets to Reduce Risks; Fuel Tanks Scrutinized*, (McLean VA: Nov. 19, 2003 p. B.03), Final Edition, Copyright 2003 Gannett Company, Inc., USA Today.

Alan Levin, *Jets Must Be Altered, Device Created to Stop Fuel-Tank Explosions*, (McLean VA: Feb. 17, 2004, p. A.01), Final Edition, Copyright 2004 Gannett Company, Inc., USA Today.

Alan Levin, *FAA Device Could Guard Against Terrorism; Experts: Fuel-tank System Could Help Jets Survive Missle Attack* (McLean Va: Feb. 18, 2004, p. A.03) Final Edition, Copyright 2003 Gannett Company, Inc., USA Today.

David Evans, *Safety v. Entertainment*, (Feb. 1, 2003) Avionics Magazine.

Peg Hashem, *Hamilton Sundstrand and Two Units of Cobham to Supply Nitrogen Generation System for Boeing 7E7*, Hamilton Sundstrand, a United Technologies Company, Windsor Locks, Conn., Corporate Press Release (Jul. 1, 2004).

Andrew J. Peacock, *Oxygen at High Altitude*, BMJ 1998; 317:1063-1066 (Oct. 17).

Peter W. Hochachica, *Mechanism and Evolution of Hypoxia-Tolerance in Humans*, The Journal of Experimental Biology 201, 1243-1254 (1998).

J. Hardy Tyson and John F. Barnes, *The Effectiveness of Ullage Nitrogen-Inerting Systems Against 30-mm High-Explosive Incendiary Projectiles*, Naval Weapons Center, China Lake, CA, Report JTCG/AS-90-T-004, (May 1991).

Charles L. Anderson, *Test and Evaluation of Halon 1301 and Nitrogen Inerting Against 23MM HEI Projectiles*, May 1978, Technical Report AFFDL-TR-78-66, Air Force Flight Dynamics Laboratory, Wright-Patterson Air Force Base, OH.

Paul B. Stewart, Ernest S. Starkman, *Inerting Conditions for Aircraft Fuel Tanks*, Sep. 1955, WADE Technical Report 55-418, Defense Technical Information Center, Defense Logistics Agency, Alexandria, VA.

W.L. Vannice and A.F. Grenich, *Fighter Aircraft OBIGGS Study*, vol. 1, Jun. 1987, Air Force Wright Aeronautical Laboratories, Wright-Patterson AFB, Dayton, OH 45433-6563.
T.C. Knight, J.E. Ritter, *The AH-64A Nitrogen Inerting System*, Oct. 31-Nov. 2, 1984, Hughes Helicopters, Inc., Culver City, CA.
Defendant's Answer, Affirmative Defenses and Counterclaims, *Firepass IP Holdings, Inc. and Firepass Corporation, v. The Boeing Company*, CV-08-01766 (E.D.N.Y. Jun. 20, 2008).
Aviation Rulemaking Advisory Committee Fuel Tank Inerting, Task Group 3, Jun. 28, 1998.
AFWAL-TR-85-2060, Vulnerability Methodology and Protective Measures for Aircraft Fire and Explosion Hazards, vol. I, 1986, 42 pgs.
AFWAL-TR-85-2060, Vulnerability Methodology and Protective Measures for Aircraft Fire and Explosion Hazards, vol. II, 1986, 139 pgs.
AFWAL-TR-85-2060, Vulnerability Methodology and Protective Measures for Aircraft Fire and Explosion Hazards, vol. III, 1986, 429 pgs.
Airbus Americas Inc., Defendants Opening Claim Construction Brief, 30 pgs, Feb. 1, 2011.
Airbus Americas Inc., Defendants' Opposition Claim Construction Brief, Mar. 18, 2011, 30 pgs.
Airbus Americas Inc., Defendants' Supplemental Opening Brief, Opposition Claim Construction Brief, Mar. 1, 2011, 16 pgs.
Desmarais, et al., AFWAL-TR-83/2021, vol. II Integrated Aircraft Fuel Tank Inerting and Compartment Fire Suppression, [Exh. 20 -pp. 4985-5227], Apr. 1983, 243 pgs.
FirePass IP Holdings Inc., Plaintiff's Opening Claim Construction Brief, Feb. 1, 2011, 51 pgs.
FirePass IP Holdings Inc., Plaintiff's First Supplemental Preliminary Infringement Contentions, Nov. 12, 2010, 63 pgs.
FirePass IP Holdings Inc., Plaintiff's Rebuttal Claim Construction Brief, Mar. 18, 2010, 31 pgs.
Gustafsson, et al., Effects of Normobaric Hypoxic Confinement on Visual and Motor Confinement, Aviation, Space and Environmental Medicine, vol. 68 No. 11, Nov. 1997, 8 pgs.
Knight, D.R., The Medical Hazards of Flame Suppressant Atmospheres, NWMRL Report 1167, Apr. 19, 1991, 24 pgs.
Kuchta, J.M., "Oxygen Dilution Requirements for Inerting Aircraft Fuel Tanks," Bureau of Mines, U.S. Dept. of Interior, Second Conference on Fuel System Fire Safety, May 1970, 21 pgs.
Manatt, S.A., Hollow Fiber Permeable Membrane for Airborne Inert Gas Generation, Society of Automotive Engineers, Oct. 1974, 11 pgs.
Ott, E.E., et al. "Influence of Fuel Slosh Upon the Effectiveness of Nitrogen Inerting for Aircraft Fuel Tanks," Technical Report AFAPL-TR-70-82, Feb. 1971,32 pgs.
Tyson, J.H., et al., "The Effectiveness of Ullage Nitrogen-Inerting Systems Against 30-mm High-Explosive Incendiary Projectiles," Final Report JTCG/AS-90-T-004, May 1991, 155 pgs.
Zinn, S.V. et al., "Inerted Fuel Tank Oxygen Concentration Requirements," Interim Report, FAA-RD-71-42, Aug. 1971, 23 pgs.
Daniel R. Bower, Ph.D., *Flight Test Group Chairman's Factual Report of Investigation*, Jul. 17, 1996, NTSB/SA-516, 96 Kb, 24 pages, FAA White Papers.
Ivor Thomas, *FAA R&D Efforts on Flammability*, Aug. 14, 2002, 2.3 Mb, 27 pages, FAA White Papers.
Alan Levin, *Lower cost, higher risk helped alter FAA stance*, (McLean, Va: Feb. 17, 2004. p. A.03), Copyright 2004 Gannett Company, Inc., USA Today.
Alan Levin, *FAA Suggests Airbus Modify Jets to Reduce Risks; Fuel Tanks Scrutinized*, (McLean Va: Nov. 19, 2003 p. B.03), Final Edition, Copyright 2003 Gannett Company, Inc., USA Today,.
Alan Levin, *Jets Must Be Altered, Device Created to Stop Fuel-Tank Explosions*, (McLean Va: Feb. 17, 2004, p. A.01), Final Edition, Copyright 2004 Gannett Company, Inc., USA Today.
Alan Levin, *FAA Device Could Guard Against Terrorism; Fuel-tank System Could Help Jets Survive Missle Attack* (McLean Va: Feb. 18, 2004, p. A.03) Final Edition, Copyright 2003 Gannett Company, Inc., USA Today.
David Evans, *Safety v. Entertainment*, (Feb. 1, 2003) Avionics Magazine.
Peg Hashem, *Hamilton Sundstrand and Two Units of Cobham to Supply Nitrogen Generation System for Boeing 7E7*, Hamilton Sundstrand, a United Technologies Company, Windsor Locks, Conn., Corporate Press Release (Jul. 1, 2004).
Andrew J. Peacock, *Oxygen at High Altitude*, BMJ 1998; 317:1063-1066 Oct. 1998.

* cited by examiner

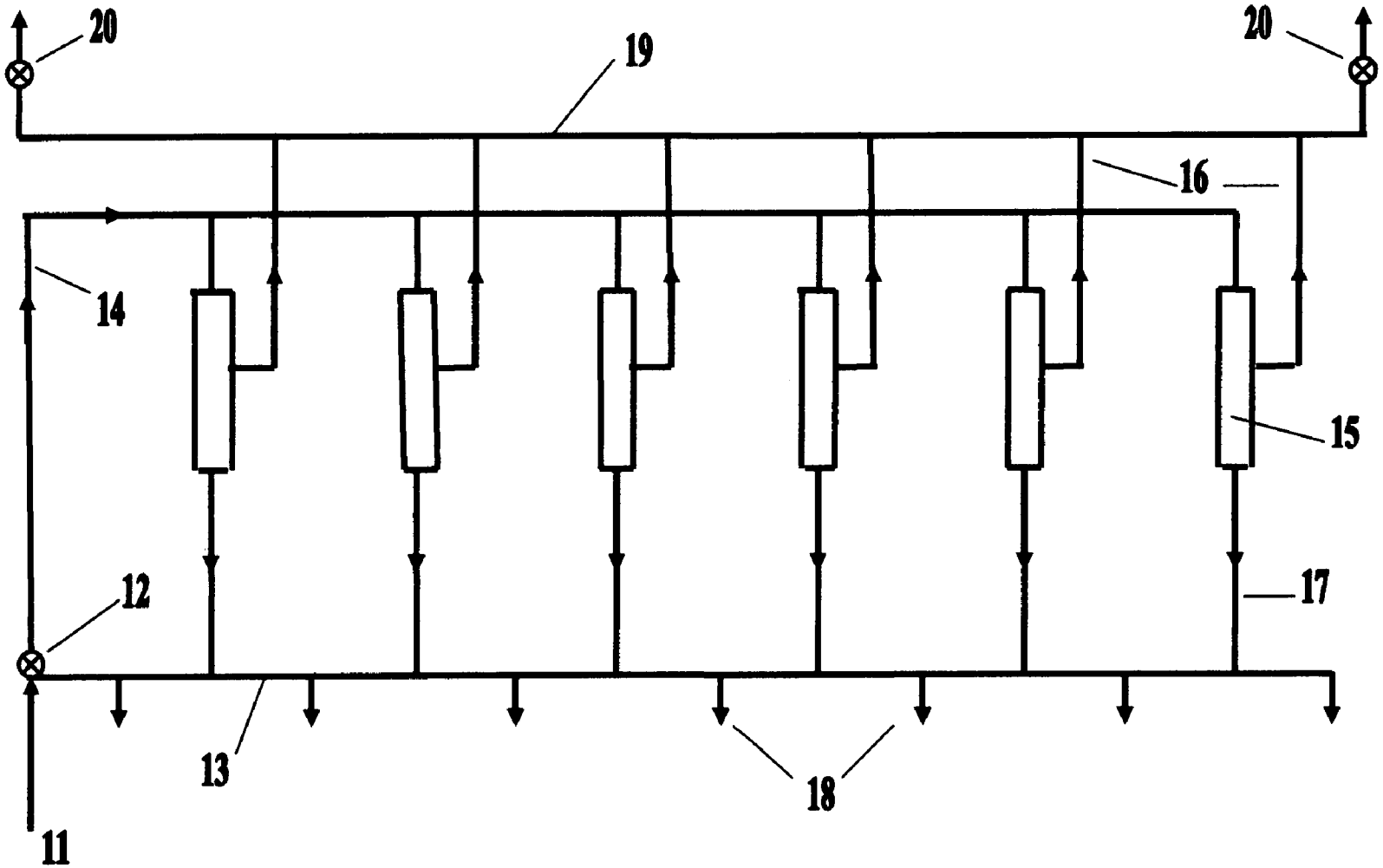
20
20
19
16
15
17
18
13
14
12
11

HYPOXIC FIRE SUPPRESSION SYSTEM FOR AEROSPACE APPLICATIONS

This invention is a continuation in part of U.S. Ser. No. 10/726,737, filed Dec. 3, 2003, "Hypoxic Aircraft Fire Prevention and Suppression System with Automatic Emergency Oxygen delivery System" and U.S. Ser. No.: 09/551,026, filed Apr. 17, 2000; U.S. Ser. No. 09/566,506, filed May 8, 2000; U.S. Ser. No. 09/854,108, filed May 11, 2001; U.S. Ser. No. 09/750,801, filed Dec. 28, 2000; U.S. Ser. No. 09/975,215, filed Oct. 10, 2001; U.S. Ser. No. 10/078,988, filed Feb. 19, 2002; and U.S. Ser. No. 10/024,079, filed Dec. 17, 2001; now U.S. Pat. Nos.: 6,314,754; 6,334,315; 6,401,487; 6,418,752, 6,502,421, 6,557,374 and 6,560,991, respectively.

SUMMARY OF THE INVENTION

This invention is based on the fact that hypoxic air can suppress fire while people can breathe and on the fact that an air separation membrane can produce several times more of hypoxic air with necessary O2 content (preferably 12%-14%) then it can produce nitrogen. Moreover, much lower feed air pressure is needed to produce such hypoxic air than nitrogen that cannot be used to extinguish fire in a passenger aircraft. Most of technologies utilize suppression principle for aircraft fires using chemical agents, but no one suggested the use of oxygen-enrichment membranes or other air-separation devices for suppression.

Further, this invention describes that multiple lightweight membranes or other air-separation devices (pressure-swing adsorption units, etc.) can produce rapidly necessary quantities of hypoxic air in order to flood the aircraft cabin and/or cargo compartment with hypoxic air, which will extinguish any fire at very beginning.

Furthermore, the invented design and method are based on the exposure of the oxygen outlet of an air separation device to the negative pressure of the outside atmosphere at aircraft cruise altitudes, which increases the productivity of the hypoxic air significantly. The productivity effect of such design will be the same as traditional design of an air separation device receiving feed air from a compressor and having a vacuum pump on the oxygen outlet. Though, the invented system utilizes engine's bleed air instead of compressor and the negative pressure of the outside atmosphere instead of a vacuum pump.

The lower operating pressure and exposure to the partial vacuum allows to effectively using lightweight air separation membranes or other devices in sizes and quantities necessary for producing fire-extinguishing hypoxic atmosphere within aircraft cabin within 1-3 minutes after detection of smoke or fire.

DESCRIPTION OF THE INVENTION

FIG. 1 describes schematically the main idea of this invention. Engine's bleed air from line 11 is normally supplied for the aircraft cabin ventilation through three-way valve 12 into line 13 being discharged further through nozzles 18 into aircraft cabin. In case of a fire emergency valve 12 is actuated closing line 13 and sending all available bleed air into line 14.

Multiple lightweight air-separation devices 15, preferably oxygen-enrichment membranes, are connected to line 14 with their inlet and receive bleed air under pressure from line 14. This causes a separation of bleed air into oxygen enrichment fraction and oxygen-depleted (hypoxic) fraction. Oxygen-enriched fraction is wasted from the system via outlets 16 into line 19 and hypoxic fraction is forwarded via conduits 17 into ventilation line 13 being further released into cabin via nozzles 18. This allows to rapidly establish hypoxic fire-extinguishing atmosphere inside of an aircraft cabin or other compartment having oxygen content from 12% to 16% depending on application (recommended is 14%-15%).

Oxygen-enriched waste gas is forwarded from outlets 16 into line 19 having one or more release valves 20 that, when open, allow the discharge of the waste gas into outside atmosphere. Valves 20 are optional and line 19 can be permanently open to the outside atmosphere if the design of the separation device 15 prevents air circulation in the opposite direction.

Bleed air is available on board of a modern passenger aircraft, such as Boeing 747, in large quantities, though at a limited pressure, which is still sufficient for a productive air separation by devices 15. The greatest advantage of the invented system is that when valves 20 are open, the vacuum suction effect of the outside atmosphere on cruise heights (about 10 km) is employed. This alone can double or triple the productivity of membranes (or other air separation devices) 15. In some applications, an independent compressed air source can be utilized instead of the bleed air from the aircraft engine. A compressor or a set of compressors or blowers can be installed onboard in order to feed the air separation system in a case of fire.

The principle of applying a vacuum pump on one of the outlets of an air separation membrane is known to those skilled in the art. A typical design comprises a compressor that drives air under pressure (usually about 100 bar) into such membrane for separation and a vacuum pump on an outlet allows to significantly increasing overall productivity and/or reduce compressor performance. However, no one before suggested the use of the reduced atmospheric pressure outside of an aircraft in order to significantly increasing the production of the hypoxic air. This alone allows reducing the number and weight of membranes 15 and achieving effective air separation even by employing a relatively low feed pressure of the bleed air on board of an aircraft.

Obviously, the invented system is quite unusual—no compressor and no vacuum pump being utilized. Membranes 15 can utilize low-pressure bleed air and the partial vacuum of the outside atmosphere, which makes the system work more efficiently—otherwise it would be impossible to achieve cost-effectively the fast flooding of the aircraft cabin with hypoxic air.

Additionally this design does not require strong shell around the membrane that can be made from lightweight composite material. Such high-flux membranes are available from FirePASS Corporation in New York. One of them is about 100 cm long and 15 cm in diameter weighting only about 4 kg. The productivity of this membrane in the above-described configuration is about 1 m3/min of hypoxic air.

The oxygen content in hypoxic fraction can reach form 10% to 15% depending on application, 12% O2 is preferred. It means that 50 of such membranes distributed along the cabin interior (e.g. behind the ceiling) would achieve the fire extinguishing atmosphere having 14%-16% O2 in a Boeing 747 cabin within 3-4 minutes. Actually, the flame will start diminish and will stop propagate when the O2 content drops below 18%, which may be achieved within 1-2 min. At altitudes over 3 km the extinguishing effect for class A,B and C fires can be achieved in the atmosphere containing 15%-17% of oxygen.

Once the desired oxygen content, for instance 15%, is achieved, the bleed air pressure or flow can be regulated by a computerized control the way that the oxygen content in the incoming hypoxic fraction will be also 15%. After the fire extinguished the oxygen content in the hypoxic fraction can be adjusted to 16% that will help to prevent reignition. If the fire source is located and neutralized the oxygen content in the cabin can be kept at a precautious level of 18% or the normal ventilation can be resumed. The invented system can be used as many times as needed and will never run out of the "suppression agent".

During the initial stage of the fire suppression, a necessary amount of water mist or foam may be generated by using hypoxic fraction as propellant. The water mist or foam can be generated inside selected protected compartments of the aircraft by using necessary amounts of water or foam generating liquid. This method is described in the previous application U.S. Ser. No. 10/726737.

It is also possible to build special long (10-20 m) membranes that would produce each 10-20 m3/min of hypoxic air—the bigger the length of a membrane, the better the separation factor.

The fire extinguishing atmosphere on board of a passenger aircraft having oxygen content of 14% may provide discomfort to some passengers; therefore some of the oxygen enriched waste from line 19 should be supplied to passengers for respiration via masks. This can be easily achieved by installing a vacuum pump that in emergency will draw necessary amount of the oxygen reach waste for delivery to passengers. The advantage of such emergency oxygen supply is that it can last for as long as needed compare to the oxygen supply from onboard bottles.

Obviously, any other air separation device can be used instead of the oxygen-enrichment membrane 15. Flat oxygen permeable membranes, Pressure-Swing and Temperature-Swing Adsorption devices can be utilized as well.

Flat oxygen permeable membranes can be used in airspace applications in order to rapidly lower the oxygen content in the internal atmosphere of an aircraft or space vehicle. Flat membranes can be incorporated in the wall structure of the aircraft so that, when needed, they can be exposed to the vacuum outside of the air- or spacecraft. In this case such flat membranes will allow oxygen molecules through while blocking nitrogen molecules from leaving the internal atmosphere. This way the oxygen content can be rapidly lowered in an emergency situation. Controlled exposure will allow to keeping oxygen content at a safe level (for instance, from 12% to 18%). This design does not require any bleed air and can be utilized for space craft and other airspace applications.

The use of a permanent fire-extinguishing hypoxic atmosphere for fire prevention was described in the previous application U.S. Ser. No. 10/726737. Though, the main subject of this invention is a safe and a rapid creation of the hypoxic atmosphere for fire suppression, since it would be uncomfortable for passengers to be exposed to hypoxic atmosphere all the time during the flight.

This invention can resolve completely the most complex problem of the fire emergency landing since an aircraft flooded with such breathable hypoxic fire-extinguishing atmosphere can continue its flight for hours to its destination or until an acceptable landing airport found.

The invention claimed is:

1. A method of a rapid providing of a breathable fire-suppressive atmosphere onboard of an aircraft, said method comprising:

use of compressed atmospheric air in an air separation system for generating hypoxic gas mixture; said air separation system having a hypoxic product outlet and an oxygen-enriched fraction outlet;

exposure of said oxygen-enriched fraction outlet to a negative pressure of an outside atmosphere at an aircraft altitude, in order to significantly increasing the productivity of said air separation system;

said hypoxic product outlet communicating with an aircraft interior and transmitting said hypoxic gas mixture;

said air separation system, being activated in case of a fire emergency, flooding protected aircraft compartments with said hypoxic gas mixture and establishing and breathable fire-suppressive atmosphere onboard for as long as needed;

said breathable fire-suppressive atmosphere having oxygen content from 12% to 18% depending on the aircraft altitude.

2. The method of claim 1 wherein said system consists of multiple air separation devices connected together in order to provide sufficient quantities of the hypoxic gas mixture for rapid establishing of the breathable fire-suppressive atmosphere.

3. The method of claim 1 wherein said protected compartments may include passenger cabin, cargo compartments, fuel tanks and other compartments of an aircraft.

4. The method of claim 1 wherein said hypoxic gas mixture being used as propellant for generating water mist or foam inside selected protected compartments by using necessary amounts of water or foam generating liquid.

5. The method of claim 1 wherein said compressed atmospheric air being bleed air supplied by an aircraft engine.

6. The method of claim 1 wherein said compressed air being supplied by an independent compressor or a set of multiple compressors or blowers.

7. The method of the claim 1 wherein a part of said oxygen enriched fraction being sent to passengers respiratory masks for inhalation during an emergency, said fraction may contain oxygen in a range from 30% to 90%.

8. A method of a rapid creation of a breathable fire-suppressive atmosphere onboard of a space vehicle, said method comprising:

a controlled exposure of oxygen permeable membranes to a negative pressure or vacuum outside of the space vehicle in order to rapidly depleting an internal atmosphere of oxygen to a level from 12% to 18%.

9. Apparatus for the suppression of fire in a compartment onboard an aircraft traveling in an outside atmosphere, comprising:

an air separation device having an inlet, a first outlet, and a product outlet, said air separation device separating air input at said inlet to an oxygen-enriched fraction and a hypoxic fraction, said oxygen-enriched fraction being passed to said first outlet and said hypoxic fraction being passed to said product outlet; said air separation device being located inside said aircraft;

a source of air coupled to said air separation device inlet;

said product outlet being in communication with a discharge outlet, said discharge outlet being in communication with said aircraft compartment;

a valve interposed between said product outlet and said discharge outlet, said valve having at least an open condition to pass said hypoxic fraction into said aircraft compartment to reduce an oxygen content in an aircraft compartment atmosphere to a level between 12% and 18%, providing a fire extinguishing environment.

10. The apparatus of claim 9 wherein said air source further comprises an aircraft engine bleed air coupled to said air separation device inlet.

11. The apparatus of claim 9 wherein said air source further comprises an air compressor having a positive pressure air output coupled to said air separation device inlet.

12. The apparatus of claim 9 wherein said air source further comprises a blower having a positive pressure air output coupled to said air separation device inlet.

13. The apparatus of claim 9 wherein said air separation device and discharge outlet further comprises a first plurality of air separation devices, a second plurality of discharge outlets, and a first conduit system connecting said first plurality of air separation device product outlets to said second plurality of discharge outlets to deliver said hypoxic fractions into said compartment.

14. The apparatus of claim 13 further comprising a second conduit system connecting said first plurality of air separator device first outlets with said outside atmosphere.

15. The method of claim 9 wherein said air separation device comprises an air separation membrane technology.

16. The method of claim 9 wherein said air separation device comprises a pressure swing adsorption technology.

17. The apparatus of claim 9 wherein the aircraft compartment further comprises a passenger cabin having a ventilation system, further comprising a conduit system connecting said product outlet to said ventilation system.

18. The apparatus of claim 17 wherein said passenger cabin further comprises passenger respiratory masks for inhalation during an emergency, said apparatus further comprising a second conduit system selectively coupling said first outlet to said passenger respiratory masks, said second conduit system having a first condition in which a portion of said oxygen enriched fraction is communicated to said respiratory masks in case of a fire emergency.

19. The apparatus of claim 9 further comprising an actuator coupled to said valve to place said valve in said open condition in case of a fire emergency.

20. The apparatus of claim 9 wherein the fire extinguishing environment has an oxygen content of from 12% to 16%.

21. The apparatus of claim 9 wherein the fire extinguishing environment has an oxygen content of from 14% and 15%.

22. The apparatus of claim 9 wherein the fire extinguishing environment has an oxygen content of less than 18% within three minutes of said valve being placed in said open condition.

23. The apparatus of claim 9 wherein the fire extinguishing environment in said compartment is maintained for a period of time while said aircraft travels in said outside atmosphere.

24. The apparatus of claim 23 wherein said period of time further comprises at least two hours.

25. The apparatus of claim 9 wherein said first outlet is a waste outlet in open communication with said outside atmosphere, said outside atmosphere having a negative pressure relative to said aircraft compartment, facilitating separation of said air supply into said oxygen-enriched and hypoxic fractions.

26. A method for the suppression of fire in a compartment onboard an aircraft traveling in an outside atmosphere comprising:

receiving a supply of air and separating the air into an oxygen-enriched fraction and a hypoxic fraction;

passing said oxygen-enriched fraction to a first outlet;

passing said hypoxic fraction to a product outlet;

providing an aircraft compartment with a discharge outlet and a conduit for passing said hypoxic fraction from said product outlet through said discharge outlet into said aircraft compartment; and passing said hypoxic fraction through said discharge outlet into said aircraft compartment, to reduce an oxygen content in an aircraft compartment atmosphere to a level between 12% and 18%, providing a fire extinguishing environment.

27. The method of claim 26 further comprising providing as said source of air one of an aircraft engine bleed air, an air compressor output, and a blower output, said air source having a positive pressure relative to said aircraft compartment.

28. The method of claim 26 wherein separating the air supply into an oxygen-enriched fraction and a hypoxic fraction further comprises providing a plurality of air separation devices each receiving said air supply and producing at a first outlet said oxygen-enriched fraction and at a product output said hypoxic fraction, and wherein providing said discharge outlet further comprises providing a plurality of discharge outlets, and in response to a fire emergency passing said plurality of hypoxic fractions through a conduit system to said plurality of discharge outlets into said compartment.

29. The method of claim 26 further comprising passing said oxygen-enriched fraction to said outside atmosphere, said outside atmosphere having a negative pressure relative to said air supply and facilitating said air separation.

30. The method of claim 26 further comprising providing said compartment with passenger respiratory masks for inhalation during an emergency, and passing at least a portion of said oxygen-enriched fraction to said respiratory masks in case of an emergency.

31. The method of claim 26 further comprising providing the fire extinguishing environment with an oxygen content of from 12% to 16%.

32. The method of claim 26 further comprising providing the fire extinguishing environment with an oxygen content of between 14% and 15%.

33. The method of claim 26 further comprising detecting a fire emergency and providing the aircraft compartment with a fire extinguishing environment having an oxygen content of less than 18% within three minutes of said fire emergency detection.

34. The method of claim 26 further comprising maintaining the fire extinguishing environment in said compartment for a period of up to several hours after detecting said fire emergency while said aircraft travels in said outside atmosphere.

* * * * *